United States Patent [19]

St-Jean

[11] 4,401,870

[45] Aug. 30, 1983

[54] MODULAR SUCTION-GAS-COOLED MAGNETIC BLAST CIRCUIT BREAKER

[75] Inventor: Guy St-Jean, Longueuil, Canada

[73] Assignee: Hydro-Quebec, Montreal, Canada

[21] Appl. No.: 320,140

[22] Filed: Nov. 10, 1981

[51] Int. Cl.[3] ..... H01H 33/18

[52] U.S. Cl. ..... 200/147 R

[58] Field of Search ..... 200/147 R

[56] References Cited

U.S. PATENT DOCUMENTS

| | | | |
|---|---|---|---|
| 2,443,650 | 6/1948 | Berkey | 200/147 R |
| 3,566,201 | 2/1971 | Sakshaug et al. | 200/147 R |

FOREIGN PATENT DOCUMENTS

| | | | |
|---|---|---|---|
| 1109180 | 9/1955 | France | 200/147 R |
| 187821 | 11/1922 | United Kingdom | 200/147 R |
| 957359 | 5/1964 | United Kingdom | 200/147 R |

*Primary Examiner*—Robert S. Macon

*Attorney, Agent, or Firm*—Schwartz, Jeffery, Schwaab, Mack, Blumenthal & Koch

[57] ABSTRACT

A gas-cooled magnetic blast circuit breaker made up of a plurality of identical modules. Each module is a flat body made of electrically non-conductive air-permeable material and is formed with an upper and a lower arc breaking chamber, the chambers being separated from one another by a central wall of the body. An electrically conductive stationary contact member is provided in each chamber, each member extending through the body for connection to the power line on opposite faces of the body. There is also provided an electrically conductive dual contact member which is pivotally mounted across the central wall of the body, this dual member having a contact gate at each end, each gate being located in one of the chambers to cooperate with the stationary contact member in that chamber. A pivotable shaft, made of electrically non-conductive material, extends transversely through the body and is connected to the dual contact member to pivot it whereby to move the contact gates simultaneously into and out of electrical junction with the stationary contact members so as to make and break current in the power line. There is provided a coil which is energizable by the current in the power line and which is adapted to create a magnetic field suitable to blow, into the arc chambers, arcs that are formed when the contact gates are moved away from the stationary contact members. The chambers are formed so as to be provided with guideways extending from outside the body to the contact members so that air may be sucked into the chamber by the blown arcs so as to cool the contact members.

12 Claims, 8 Drawing Figures

FIG. 4
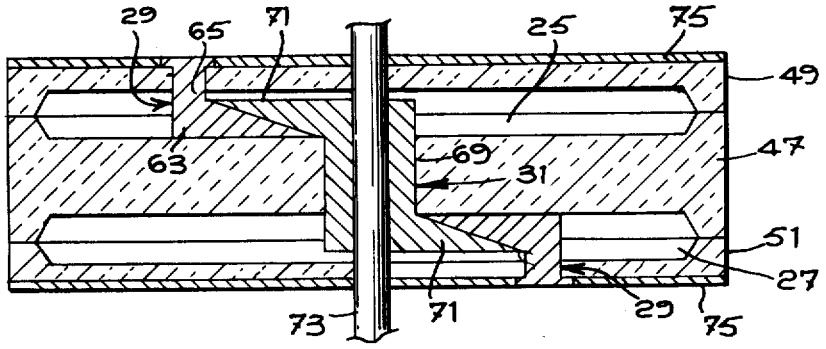
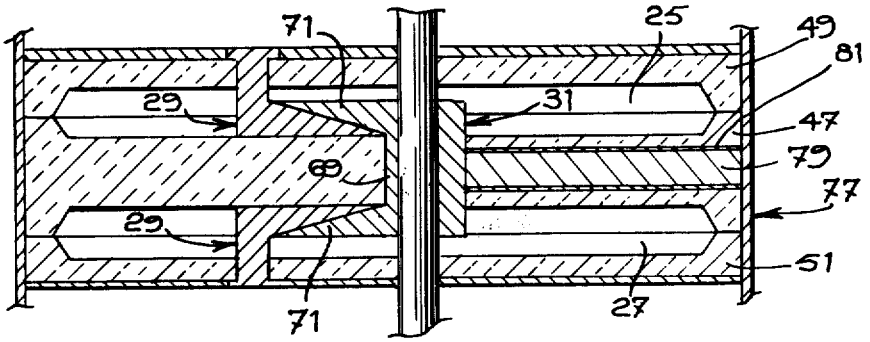
FIG. 5
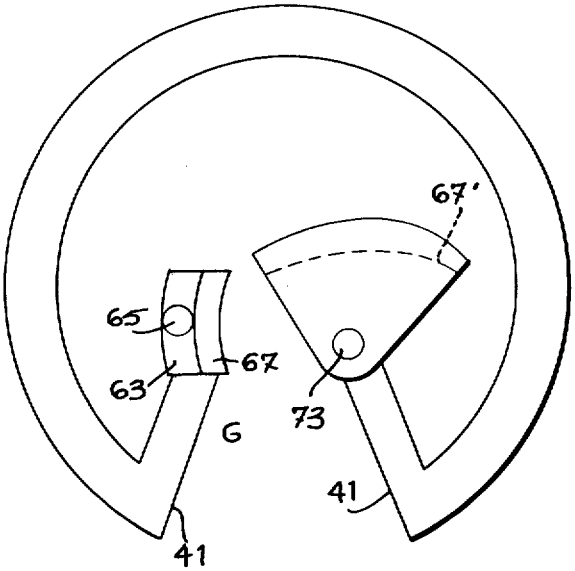
FIG. 6

MODULAR SUCTION-GAS-COOLED MAGNETIC BLAST CIRCUIT BREAKER

The present invention relates to the interruption of high ac or dc currents in high voltage electric circuits by means of circuit breakers.

More specifically, the circuit breaker of the present invention is essentially of the magnetic-blast type in which the current to be interrupted flows through a coil which builds up a strong magnetic field capable of stretching the electric arc produced as soon as the breaker contact members separate from one another. Stretching of the arc causes the voltage across the arc to increase rapidly and force the current to zero thereby interrupting it.

Conventional magnetic-blast circuit breakers usually have a single breaker assembly made up of a stationary contact member and a movable contact member between which members the electric are strikes upon opening of the contact members and during flow of electric current. The arc is driven out and away from the contact members by a magnetic field perpendicular to the contact members and produced by a coil electrically connected in series with the contact members through which flows the current which is to be interrupted. The arc voltage, which always has a polarity opposing the voltage of the source, is proportional to the length of the arc and increases as the arc stretches to finally cause a reduction of current to zero at which time current interruption takes place. In order to thus increase the arc voltage by increasing the arc length, use is made in conventional breakers of a multiplicity of chambers located downstream with respect to the movement of the arc. In this manner, the initial arc is sectionalized into a series of short elementary arcs that stretch into loops in the chambers until finally the voltage has increased to a point where the current comes to zero. These elementary arcs are then individually cooled in each chamber. The problem with a circuit breaker of the above conventional type is that, because it uses only a single contact assembly, extensive total arc lengths and high voltages are required in order to interrupt the current. Also, for the same reason, the arc speed produced is low. Conventional breakers of this type are also limited, in use, by the electrical insulation resistance of the single contact assembly.

With the present invention, I have avoided the above limitations by providing a circuit breaker based on an entirely different concept wherein a standardizable module is used which provides two consecutive chambers having their contact assemblies electrically connected together in series and mechanically operated simultaneously in a simple and compact package capable of extremely short interruption time.

As an extension of this basic concept and where higher voltages are involved, use is made of a plurality of identical superposable twin-chamber modules of the above type. The modules are stacked one upon the other and secured together in such a manner that the breaker assembly in all the chambers are series connected. Furthermore, all movable contact members of the aforesaid assemblies are mechanically interconnected so that the assemblies can be simultaneously opened and closed. Provision is also made that, as the arc accelerates away from the contact assemblies, a suction is created behind the arc which draws gas, usually air, from outside the chambers and across the open contact members whereby to improve the insulation of each chamber during and after current interruption while cooling the contact members.

More specifically, I have provided a new gas-cooled magnetic-blast circuit breaker for mounting on an electric power line, which breaker includes at least one module essentially comprising: a generally flat body made of electrically non-conductive air-permeable material and formed with an upper and a lower arc breaking chamber, the chambers being separated from one another by a central wall of the body; a pair of electrically conductive stationary contact members, each mounted in one of the chambers, the members extending through the body and to opposite faces of the body; an electrically conductive dual contact member pivotally mounted across the central wall and having a contact gate at each end thereof, each contact gate being located in one of the chambers for cooperating with the stationary contact member therein; a pivotable shaft, made of electrically non-conductive material, extending transversely through the body and connected to the dual contact member to cause pivotal motion thereof whereby to move the contact gates simultaneously into and out of electrical junction with the stationary contact members thereby to make and break contact in the power line; a coil energizable by the current in the power line and adapted to create a magnetic field suitable to blow, into the arc breaking chambers, arcs that are formed when the contact gates are moved away from the stationary contact members, and means in the chambers defining guideways extending from outside the body to the contact members to lead gas, sucked in by the blown arcs, to the contact members for cooling thereof.

According to the use intended, the coil may be mounted either in series with the current line formed by the electrically interconnected contact members or in parallel across it.

As mentioned above, and where use justifies it, the modular magnetic-blast circuit breaker may comprise a plurality of modules stacked one over the other and secured together. Each module may further have heat dissipating non-magnetic metal plates secured over its opposite faces and electrically connected to the stationary contact member. In such a case, the shaft has a length as to interconnect the dual members of all of the modules so that the contact assemblies of all modules can be operated simultaneously.

A stack of modules such as above described, may be used as a current limiter by using a large coil in which the ends are electrically connected to the heat dissipating metal plates of the terminal modules of the stack.

The principle of my invention will now be further explained, and specific embodiments thereof described, with reference to the appended drawings wherein:

FIGS. 4 and 5 are cross-sectional views of twin-chamber modules according to two different embodiments;

FIG. 6 is a plan view of a module made according to ny invention with the top disk removed to show the ırcing chamber and contact assembly;

Figure 1:
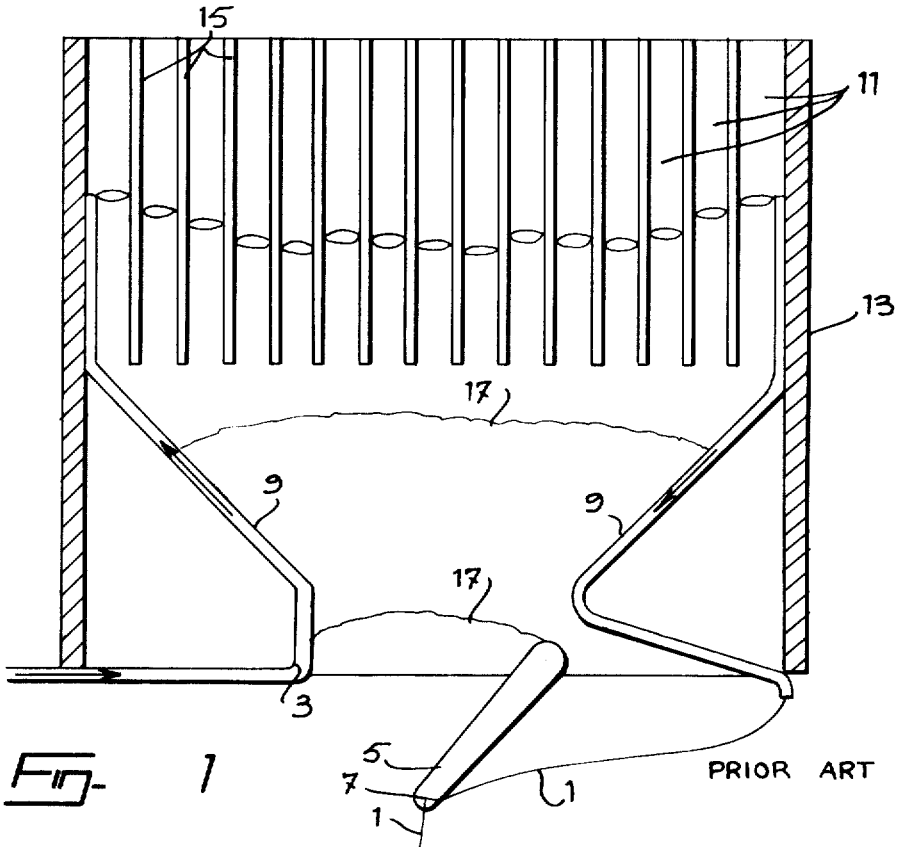
FIG. 1 PRIOR ART
FIG. 1 is a diagrammatic cross-section of a conventional magnetic-blast electric circuit breaker.

As aforesaid, FIG. 1 is intended to illustrate a magnetic-blast circuit breaker of conventional design mounted on a power line 1 and provided with a single circuit breaking assembly made up of a stationary electric contact member 3 and a movable electric contact member 5 pivoted at 7 to move to and from contact member 3. The power line 1 connects with the magnetic blow-out coil (not shown) through runners 9 between which a gap is defined in which the arc travels when blown by the perpendicular magnetic field created by the coil. In order to increase the arcing voltage, the arc is directed towards a multiplicity of chambers 11 created within the breaker casing 13 by means of a plurality of insulating fins or partitions 15. Upon separation of members 3 and 5, the arc 17 strikes immediately and eventually moves across the gap between the runners 9, being driven away from the contact assembly by the magnetic force of the coil. The arc 17 thus moves into the chambers 11 where it is sectionalized into a series of short elementary arcs which stretch into loops until the total length is sufficiently great to increase the voltage to a value capable of forcing the current in line 1 to zero.

Such a circuit breaker is limited by the insulation resistance of the breaker contact assembly 3, 5. Also, if the voltage across the line is larger, the length of arc 17 has to increase accordingly in order to interrupt the current in the line. For the above reasons, the current interruption times in circuit breakers of this type run in the tens of milliseconds. Such long interruption times rapidly erode the contacts of the breaker.

In order to avoid the aforesaid disadvantages, I have conceived a circuit breaker in the form of a module comprising two arc chambers with a current breaking assembly in each chamber, the assemblies being connected in series on the electric power line to be serviced. If the intensity of voltage across the power line warrants it, two or more such modules may be used in stacked formation with all of the breaking assemblies being series connected. In this manner, a standard size arcing chamber may be established that would provide interruption times much smaller than those available in the conventional breaker described above. In fact, I have found that the interruption time may be cut down to one millisecond with modules that can carry five kV, giving a module in the form of a generally flat body having approximately six or seven inches in diameter or, if rectangular, four or five inches in width and a thickness which need not exceed two inches. These dimensions are of course given only as examples and in no way intended to limit the scope of the present invention.

Figure 2:
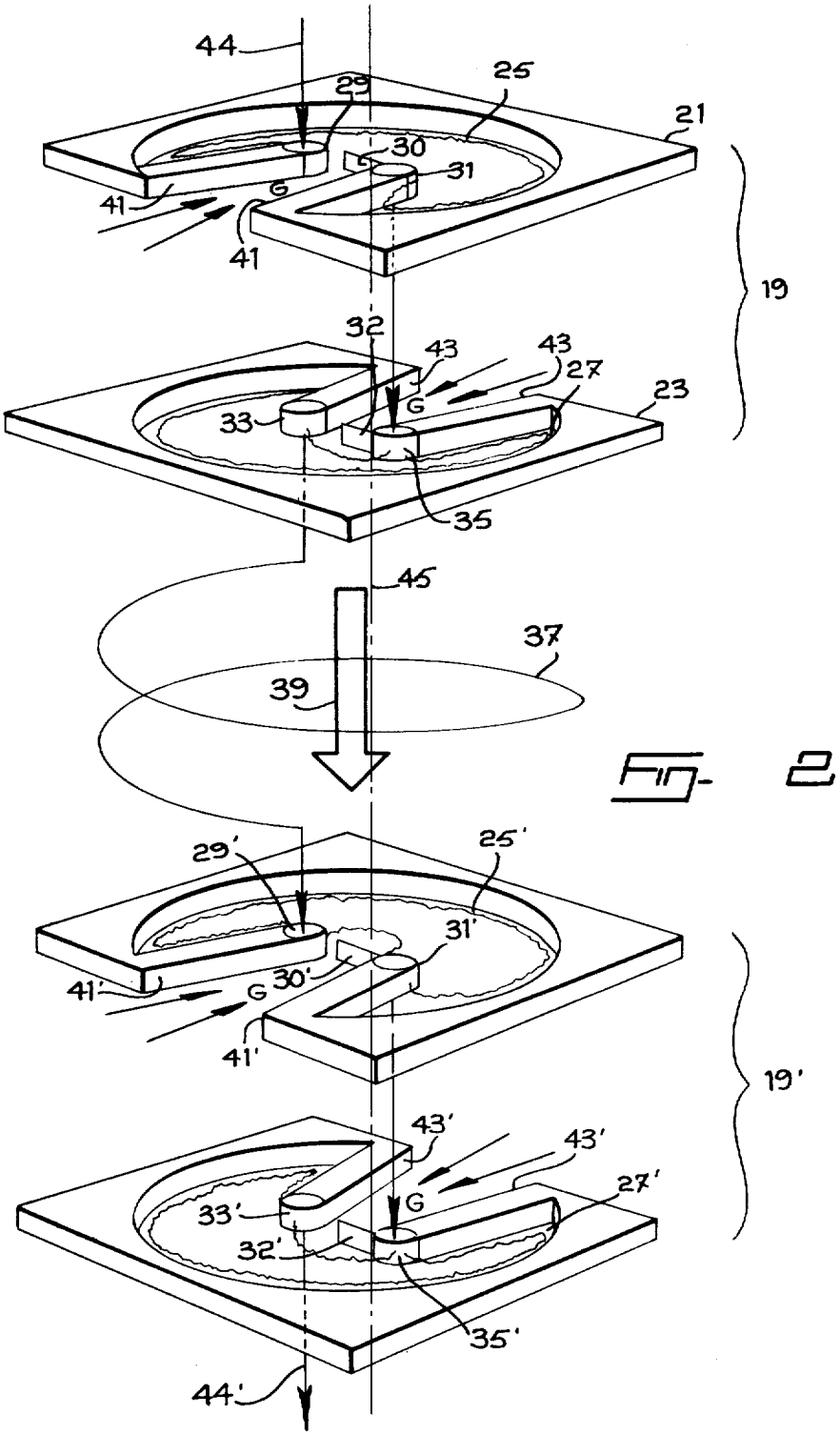
FIG. 2 is a diagrammatic perspective and exploded view intended to illustrate the principle involved in one type of circuit breaker according to my invention.

Referring now to FIG. 2, there are shown two identical modules 19, 19' so that ony the top module 19 need be described.

Module 19 comprises a body illustrated here by plates 21, 23 within each one of which a circular arc-breaking chamber 25, 27 is formed. A current interrupting circuit breaker is provided generally at the center of each chamber 25, 27, the top assembly being made up of a stationary contact member 29 and a pivotable contact member 31. Similarly, the lower chamber 27 has a current interrupting assembly made up of a stationary contact member 33 and a pivotable contact member 35.

The movable contact members 31, 35 are respectively provided with gates 30, 32 adapted to cooperate with the respective stationary contact members 29, 33 in known manner.

As will be seen, this description also applies to the lower module 19'.

Contact members 29, 31, 33 and 35 are of course made of electrically conductive non-magnetic materials such as copper.

The movable members 31 and 35 of the two assemblies are electrically connected and in fact make up a single member as will be seen hereinafter in the description of specific embodiments of the invention. A very significant feature of my invention lies in that the movable contact members 31, 35 are not only electrically interconnected, being in fact a single member provided at either end with the aforesaid gates 30, 32, but are also driven by the same shaft, made of electrically non-conductive material. This shaft also actuates the contact members 31', 35' of the lower module 19'.

A coil 37, suitable to provide a magnetic force 39, has its ends connected respectively to the stationary contact member 33 of the chamber 27 and the stationary contact member 29' of the chamber 25' of the lower module 19'.

Finally, the chambers are provided with wall means 41, 43, 41', 43', defining guideways G extending from outside the body to the respective contact members to form passages for gas or air drawn into the respective chambers, as will be explained hereinafter.

Current from the power line comes in at 44 and is applied to the stationary contact member 29 of the chamber 25, it comes out at 44' from the stationary contact member 33' of the chamber 27' in the lower module 19'. It will thus be observed that the current bridging the successive contact assemblies move in opposite directions from one assembly to the next. In other words, it moves from contact 29 to contact 31 in chamber 25 and from contact 35 to contact 33 in chamber 27, then moves through coil 37 and again from contact 29' to contact 31' of chamber 25' and from contact 35' to contact 33' in chamber 27'. Thus, when the movable gates 30, 32, 30' and 32' are simultaneously opened by the same pivoting mechanism aforesaid and acting along the dot and dash line 45, the magnetic field 39 will propel the arcs in opposite directions in successive chambers 25, 27, 25' and 27'. Under the action of the magnetic field 39, the individual arcs are stretched rapidly toward the peripheral walls of the said chambers finally to produce a voltage which is proportional to their respective lengths and which eventually cause current reduction to zero, that is current interruption.

It is again reminded that a major feature of the invention lies in that all movable contacts 31, 35, 31', 35' and their respective gates 30, 32, 30' and 32' are not only electrically interconnected but mechanically bound together so as to be driven in unison. Consequently, a very compact apparatus can be obtained wherein the operating voltage in each chamber can be relatively small thereby lowering the arc-breaking time to thus greatly reduce erosion of the contact members of the breaker assemblies.

It may finally be added that the body of the modules 19, 19' are made of electrically non-conductive air permeable material such as compacted glass bits.

Figure 3:
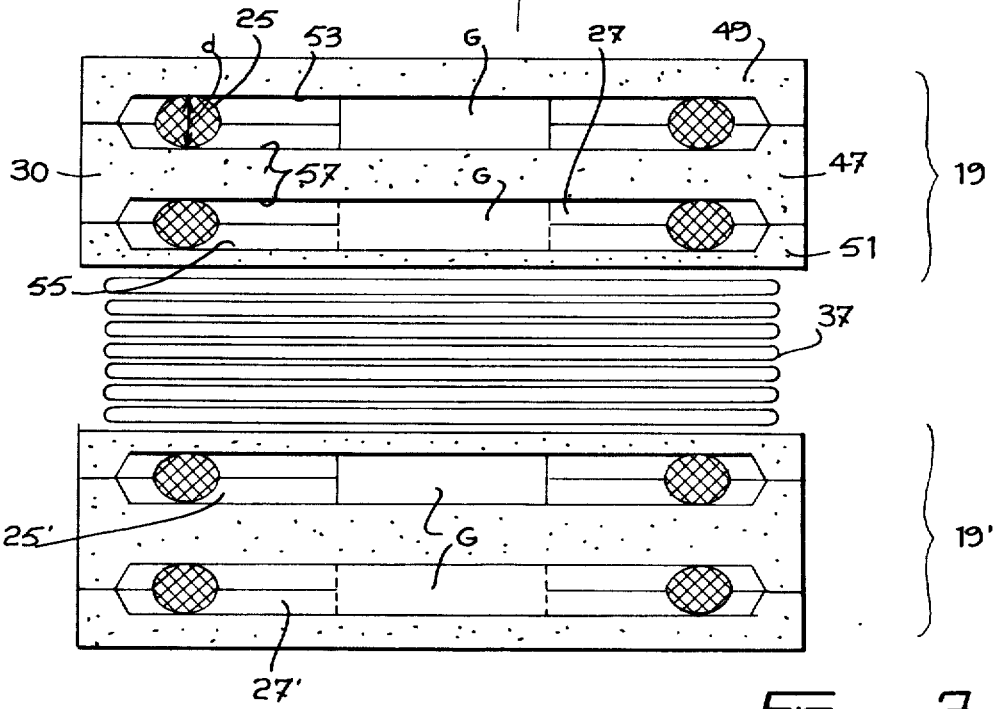
FIG. 3 is a cross-sectional view of one embodiment of a circuit breaker according to my invention and involving two twin-chamber modules.

Referring now to FIG. 3, showing a vertical cross-sectional view of the assembly diagrammatically shown in FIG. 2, it will be again seen that the modules 19, 19' are structurally identical. Preferably, each module such as module 19 is made up of an intermediate generally flat disk 47 and two outer disks 49, 51 stacked over and secured to the outer faces of the intermediate disk 47 as by means of high temperature resistant glue applied along their outer peripheries. The outer disks 49, 51 are formed on the faces thereof adjacent the intermediate disk 47 with shallow flat bottom recesses 53, 55, while the intermediate disk is formed on its outer faces with similar shallow flat-bottom recesses 57 corresponding in size and shape to the recesses 53, 55 and geometrically cooperating with them to define the arc chambers 25, 27. Also shown are the guideways G formed by the aforementioned wall means 41, 41'. For convenience, the current breaker assemblies have not been shown.

It should also be observed that the height of the various chambers 25, 27, 25' and 27' is the same and is selected so as to be equal to or smaller than the diameter d of the arcs formed in each chamber. Thus, the arcs touch the facing walls of the chambers as they are accelerated radially from the open contacts. Therefore, the centrifugal movement of the arcs, in each chamber, draws air or gas from outside the chamber into the space between the contact members. This improves the insulation resistance of the contact members, which have to support the total chamber arc voltage, by removing ionized gas between the contact members and by cooling them. The movement of the cooling gas is best illustrated by the arrows in the guideways G shown in FIG. 2. The gas which is compressed in front of the arcs flows through the chamber walls because of the porosity of the material of which the module bodies are made, as aforesaid.

It will also be noted, from FIG. 3, that the blow coil is close to the associated modules 19, 19' and thus close to its associated chambers thereby resulting in the production of a high magnetic field to accelerate the arc. I have found that such a breaker accelerates the electric arc much faster than any breaker of conventional type.

The cross-sectional views of FIGS. 4 and 5 and the plan view of FIG. 6 are intended to illustrate possible variants in the construction of breaker electric contact assemblies. It will thus be seen that each stationary contact member 29 is formed of a gate 63, secured to the intermediate disk 47 in any known manner, topped by a stud 65 extending through the outer disk, 49, 51 to the outer surface thereof. The gate 63 has a tapering surface 67 (FIG. 6). The pivotable contact member 31, on the other hand, has a central post 69 terminating, at either end with laterally projecting gates 71 provided with tapering surfaces 67' (FIG. 6) intended to come into electrical junction with the tapering contact surfaces 67 of the corresponding stationary contact members 29.

The pivotable contact member 31 of a module is secured on a pivot shaft 73 made of electrically non-conductive material, which shaft extends out of the module and is brought into pivotal movement by the use of a driving mechanism that can be of standard construction and that will readily come to the man of the art.

It will be understood from the above description that if several modules are used in series, a single shaft 73 is used to drive all contact members 31 pivotably in unison so that all contact assemblies open and close in synchronism.

From FIG. 4, it will be noted that the stationary contact members 29 are disposed on either side of the dual contact member 31 which, likewise, has its contact gates 71 extend in opposite directions. This results in a plane symmetry of the opposite faces of the intermediate disk 47 and in outer disks 49 and 51 of the same shape.

In FIG. 5, on the other hand, the modules are made in accordance with the diagrammatic view of FIG. 2 and the stationary contact members 29 are disposed one above the other, the movable contact member 31 then having its contact gates 71 projecting in the same direction away from the central post 69. This results in a linear symmetry of each module.

When several modules are to be stacked one upon the other, it is then preferable that heat dissipating non-magnetic metal plates 75 be secured over their opposite faces, that is over the outer faces of the outer disk 49, 51. These plates are then electrically connected to the studs 65 of the stationary contact members 29. The thus stacked modules may be secured together in any convenient manner such as by the use of electrically non-conductive bolts and nuts.

With particular reference to FIG. 5, when a large number of modules are to be used and the torsional resistance of the drive shaft 73 is found insufficient if the drive is applied only at one end of the said shaft 73, the following drive arrangement may be used. The modular breaker is mounted loosely in a casing 77 intended to rotate the shaft 73 and, for this purpose, the shaft 73 is connected to the casing 77 by means of links 79 extending across arcuate channels 81 formed through the intermediate disks 47 of the modules which are to be provided with such driving links 79. The number of such links will of course depend on the number of modules making up the breaker but it will be appreciated that, in this manner, the torsional stress in the shaft 73 is reduced to acceptable limits. As to the casing 77 itself it may be brought into pivotal movement relative to the breaker by any conventional drive means.

Obviously, the casing 77 as well as the links 79 have to be made of electrically non-conductive material.

As will be gathered from the above description of the embodiments of FIGS. 4, 5 and 6, it will be obvious to the man of the art that the mechanical inertia of the moving contacts is very small thereby resulting in a very high acceleration of these contacts and short contact opening time. This low inertia feature is very important because of the proximity of the blow coils to the arc chambers giving rise to a strong magnetic field producing very fast moving arcs and high arc voltages. The electrical contacts of the breaker assemblies can also better withstand their high arc voltage produced in their associated chamber because of the assistance provided by the air or gas drawn from outside by the moving arcs.

The great advantage of modular circuit breaker of the above-described type is finally that it reduces the time for the arc voltage to reach its peak and therefore to provide a faster current interruption. Current interruption time can actually be much below one millisecond and because of this feature, such a circuit breaker is useful in a multiplicity of applications such as ac breaker, ac current limiter and dc breaker.

Referring again to the diagrammatic illustration of the breaker, in FIG. 2, it can be seen that when the breaker assemblies are closed, the impedance of the breaker becomes that of the blow coil. This impedance could become significant if many modules are connected in series and would be a drawback in applications where the breaker carries current continuously. In such a case, a variant of the invention would be to connect a breaker module in parallel with its coil to shunt the latter when the breaker contacts are closed.

Figure 7:
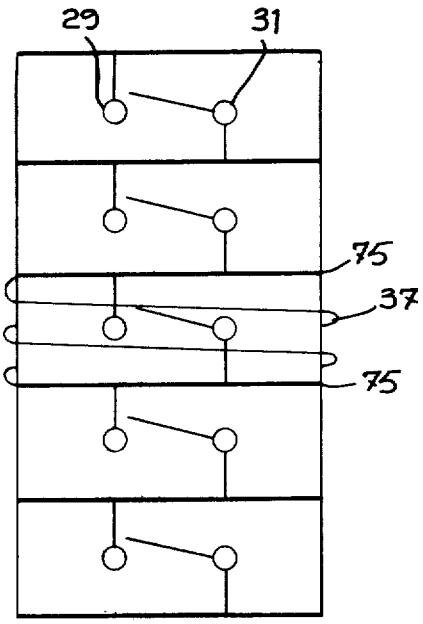
FIGS. 7 and 8 are diagrammatic elevation views of :ircuit breakers according to my invention and using a ɔlurality of basic modules.

This is the situation of the embodiment of FIG. 7 where five identical modules are used, operated by the same drive mechanism, and wherein the center module shunts the coil which has its ends electrically connected to the outer metal plates 75. When the breaker contacts are open, the arc voltages in the twin chambers of the middle module will force the current into the blow coil to produce the required magnetic field. In this variant of FIG. 7, the breaker modules have only the impedance of their breaker assemblies when the contacts thereof are closed. The blow coil 37 carries current for only the very short period in the order of one millisecond between the moment the contacts separate to the time when current is interrupted. It results that the blow coil 37 can be made of thin wire and be very compact since no permanent current or power loss occurs therethrough.

Figure 8:
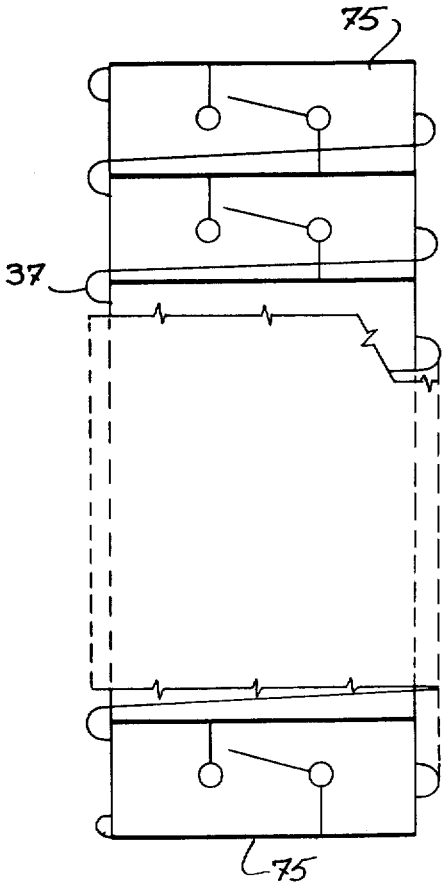

Another variant of the invention is shown in FIG. 8 wherein it is intended to use the circuit breaker with a large blow coil designed to carry current permanently or for an extended length of time thus making the circuit breaker a current limiter for ac circuit. In this application, as shown in FIG. 8, a large number of modules are series-connected and the outer plates 75 of the terminal modules are electrically joined to the ends of a current limiting coil 37 also acting on the breaker blow coil. When the contacts of the breaker assemblies are closed, the impedance of the apparatus is nil and can be positioned in series in any ac circuit. If a short circuit occurs, the breaker assemblies can be rapidly opened and the current interrupted within one millisecond and be diverted into the current limiting coil 37. The latter can be selected so that its impedance limit the short circuit current to any desired value. Such a fast acting current limiter is extremely valuable in power systems since it limits the current increase to such smaller values than the expected short-circuit values of conventional circuit breakers, thereby reducing the stress on the system equipment associated therewith.

To summarize, an ac circuit breaker made according to the invention has the advantage of forcing the current to zero within a very short time range in the order of one millisecond or less as compared to conventional circuit breakers where the breaking time is in the order of tens of milliseconds, as aforesaid. Also mentioned above, this shorter breaking time very significantly reduces the erosion of the contact members by the electric arcs. Also, since short-circuit currents in power system require up to one half of a cycle or eight milliseconds to increase to their full value, in the event of a fault, a fast-acting breaker as proposed herein can be used to limit the progress and peak value of the current, thereby acting as a current limiter.

Moreover, because the circuit breaker forces current to zero, it may be used as a high voltage dc circuit breaker.

Other variations of the present invention can be realized such as making use of high pressure gas nozzles in the aforesaid guideways G to initially blow the arcs away from the contact members if they have a tendency to stick at high current values. As will be gathered by the man of the art, this problem of arc sticking may be solved by the use of special contact material.

To improve dielectric rigidity and thermal conductivity, the circuit breaker may also be used in an ambient pressure which is higher or lower than atmospheric pressure with any appropriate insulating gases such as $SF_6$.

Another interesting application of a modular circuit breaker according to the present invention is in connection with work that has to be carried out on power lines. In such a case, the procedure is often to cut off a line section from the source and thereafter ground the ends of the line section on which work has to be done. Grounding is achieved by means of insulated hot rods having a connecting mechanism at one end to which a grounding conductor is fixed. This conductor grounds any current induced in the line section by live lines parallel to the grounded line to be repaired.

When the ground conductor has to be removed, an electric arc usually strikes between the repaired line section and the mechanism located at the end of the hot rod. This arc carries the induced current and may reach several meters in length before being interrupted. Further to the danger of the arc inadvertently jumping to other points close to the repairman, its interruption often produces an unpleasant detonation as well as constituting a danger hazard to the repairman.

The present invention thus constitutes a very light circuit breaker that can be secured at the end of the hot rod and interrupt efficiently currents up to 400 amps at voltages reaching up to 40 kV.

I claim:

1. A gas-cooled magnetic blast circuit breaker for mounting on an electric power line, said breaker including at least one module comprising:

(a) a generally flat body made of electrically non-conductive air-permeable material and formed with an upper and a lower arc breaking chamber, said chambers being separated from one another by a central wall of said body;

(b) a pair of electrically conductive stationary contact members, each mounted in one of said chambers, said members extending through said body and to opposite faces of said body;

(c) an electrically conductive dual contact member pivotally mounted across said central wall and having a contact gate at each end thereof, each contact gate being located in one of said chambers for cooperating with the stationary contact member therein;

(d) a pivotable shaft, made of electrically non-conductive material, extending transversely through said body and connected to said dual contact member to cause pivotal motion thereof whereby to move said contact gates simultaneously into and out of electrical junction with said stationary contact members thereby to make and break current in said power line;

(e) a coil energizable by the current in said power line and adapted to create a magnetic field suitable to blow, into said arc breaking chambers, arcs that are formed when said contact gates are moved away from said stationary contact members, and (f) means in said chambers defining guideways extending from outside said body to said contact members to lead gas, sucked in by said blown arcs, to said contact members for cooling thereof.

2. A circuit breaker as claimed in claim 1, wherein said contact members, when closed, from a current line and said coil is mounted in series with said current line.

3. A circuit breaker as claimed in claim 1, wherein said contact members, when closed, form a current line and said coil is mounted in parallel across said current line.

4. A circuit breaker as claimed in claim 1, 2 or 3, wherein said stationary contact members are disposed one above the other in said body to produce linear symmetry.

5. A circuit breaker as claimed in claim 1, 2 or 3, wherein said stationary contact members are disposed on either side of said dual contact member to produce plane symmetry of the opposite faces of the central wall.

6. A circuit breaker as claimed in claim 1, comprising a plurality of said one module, said modules being stacked one over the other and each further comprising: heat dissipating non-magnetic metal plates secured over said opposite faces of said body and electrically connected to said stationary contact members; wherein said contact members of said modules, when closed, from a current line and said coil is mounted in parallel across said current line whereby said circuit breaker may act as a current limiter, and wherein said shaft interconnects the dual members of all of said modules for simultaneous operation thereof.

7. A circuit breaker as claimed in claim 1, comprising an odd number of said one module, said modules being stacked one over the other and each further comprising: heat dissipating non-magnetic plates secured over said opposite faces and electrically connected to said stationary contact members; wherein said contact members of said modules, when closed, form a current line and said coil is mounted in parallel across the central one of said modules and has its ends connected to the heat dissipating plates thereof.

8. A circuit breaker as claimed in claim 1, comprising two of said modules, wherein said coil is disposed therebetween with the ends thereof electrically connected to the adjacent stationary contact members of said modules, and wherein said shaft interconnects the dual members of said two modules for rotation in unison.

9. A circuit breaker as claimed in claim 1, 6 or 7, wherein said body is made up of an intermediate generally flat disk and two outer disks stacked over and secured to the outer faces of said intermediate disk, wherein said outer disks are formed on the faces thereof adjacent said intermediate disk with shallow flat bottom recesses and said intermediate disk is formed on the outer faces thereof with shallow flat bottom recesses corresponding in size and shape to said recesses of said outer disks and geometrically cooperating therewith to define said arc chambers; each recess being further provided with wall means defining said guideways.

10. A circuit breaker as claimed in claim 8, wherein said body is made up of an intermediate generally flat disk and two outer disks stacked over and secured to the outer faces of said intermediate disk, wherein said outer disks are formed on the faces thereof adjacent said intermediate disk with shallow flat bottom recesses and said intermediate disk is formed on the outer faces thereof with shallow flat bottom recesses corresponding in size and shape to said recesses of said outer disks and geometrically cooperating therewith to define said arc chambers; each recess being further provided with wall means defining said guideways.

11. A circuit breaker as claimed in claim 1 or 7, wherein said chambers each comprises top and bottom wall surfaces spaced from one another a distance at most equal to the transverse dimension of said arcs formed therein.

12. A circuit breaker as claimed in claim 8, wherein said chambers each comprises top and bottom wall surfaces spaced from one another a distance at most equal to the transverse dimension of said arcs formed therein.

* * * * *